US006042299A

United States Patent [19]

Cooper

[11] Patent Number: 6,042,299

[45] Date of Patent: Mar. 28, 2000

[54] APPARATUS FOR REMOVAL AND COLLECTION OF ROADWAY MARKERS

[75] Inventor: George A. Cooper, San Antonio, Tex.

[73] Assignee: Cooper Equipment Company, San Antonio, Tex.

[21] Appl. No.: 09/131,582

[22] Filed: Aug. 10, 1998

[51] Int. Cl.[7] ..... E01C 23/08

[52] U.S. Cl. ..... 404/83; 37/407; 37/903

[58] Field of Search ..... 37/264, 266, 270, 37/407, 403, 233, 411; 172/445.1, 192, 815, 817; 404/73, 83, 90, 91, 93, 94

[56] References Cited

U.S. PATENT DOCUMENTS

| | | | |
|---|---|---|---|
| 631,096 | 8/1899 | Smith . | |
| 2,285,039 | 6/1942 | Lowe . | |
| 2,783,698 | 3/1957 | Bambi . | |
| 2,845,192 | 7/1958 | Klaus | 214/78 |
| 3,153,866 | 10/1964 | Bordeaux et al. | 414/553 X |
| 4,584,044 | 4/1986 | Tokunaga et al. | 156/344 |
| 4,624,601 | 11/1986 | Quittner | 404/12 |
| 5,027,906 | 7/1991 | Jeannotte et al. | 171/186 |
| 5,129,169 | 7/1992 | Aubichon | 37/231 |
| 5,172,499 | 12/1992 | Griffin | 37/117.5 |
| 5,297,351 | 3/1994 | Cote | 37/232 |
| 5,471,770 | 12/1995 | Ferreira | 37/264 |
| 5,603,382 | 2/1997 | McIver | 172/445.1 |
| 5,605,381 | 2/1997 | Schmoock, Jr. et al. | 299/39.2 |
| 5,741,112 | 4/1998 | Lakin et al. | 414/722 |

*Primary Examiner*—James A. Lisehora
*Attorney, Agent, or Firm*—Cox & Smith Incorporated

[57] ABSTRACT

An apparatus for removal and collection of roadway markers comprises a shearing blade and a collection bin mountable on a transport vehicle, the blade being forwardly disposed relative to the collecting bin, the bin having no substantial front wall. A flexible vertical skirt is disposed in forwardly surrounding relation to the blade to effect the trapping of the removed markers and the deposit thereof into the collecting bin. The collecting bin is vertically movable to a dumping position relative to a larger storage bin.

4 Claims, 4 Drawing Sheets

APPARATUS FOR REMOVAL AND COLLECTION OF ROADWAY MARKERS

FIELD OF INVENTION

This invention relates to an apparatus for removal of roadway markers or buttons by application of a shearing force to the markers by a vehicle mounted blade and effecting the automatic collection of each loose marker in a bin carried by the vehicle.

BACKGROUND OF THE INVENTION

Button shaped roadway markers adhesively or mechanically secured to the road pavement have been utilized on most, if not all, modern highways. It often happens that installed roadway markers have to be removed to effect a lane change or to permit the resurfacing of the roadway. Such removal has been heretofore accomplished by utilizing the blade of large graders to apply a shearing force to the roadway marker and then manually collecting the removed markers, which fly forwardly in a variety of directions, often going laterally off the pavement to end up in a ditch or high weeds, thus making manual collection difficult.

It is the object of this invention to provide an apparatus for mounting on a vehicle, not limited to expensive road graders, to effect the removal of highway markers from the pavement and automatically collect each removed marker in a bin carried on the vehicle.

SUMMARY OF THE INVENTION

A blade specifically constructed for highway marker removal is mounted on the bottom forward portions of a collection bin which, in turn, is mounted on any type of vehicle weighing a thousand pounds or more. The collection bin has a bottom wall, two vertical side walls and a rear vertical wall, but no substantial front wall.

A flexible vertical skirt is mounted in forwardly projecting, surrounding relationship to the portion of the blade utilized to engage and apply a forward and upward force to each highway marker.

The bottom portions of the flexible vertical skirt extend downward to a position closely adjacent to, but preferably not touching the pavement, thus, providing a front wall for the collecting bin and trapping each loose highway marker and effecting the movement thereof up and over the top surface of the severing blade to enter the primary collection bin.

The primary collection bin is horizontally pivotally mounted on the support frame and a fluid pressure cylinder is provided to pivotally elevate the primary collection bin to effect the dumping of the road markers collected therein into a larger secondary bin provided on the vehicle frame.

Thus, the expensive and time consuming manual collection of removed highway markers is eliminated.

Further objects and advantages of this invention will become obvious to those skilled in the art from the following detailed description of a preferred embodiment of the invention, taken in conjunction with the annexed sheets of drawings.

DETAILED DESCRIPTION OF PREFERRED EMBODIMENT

Figure 1:
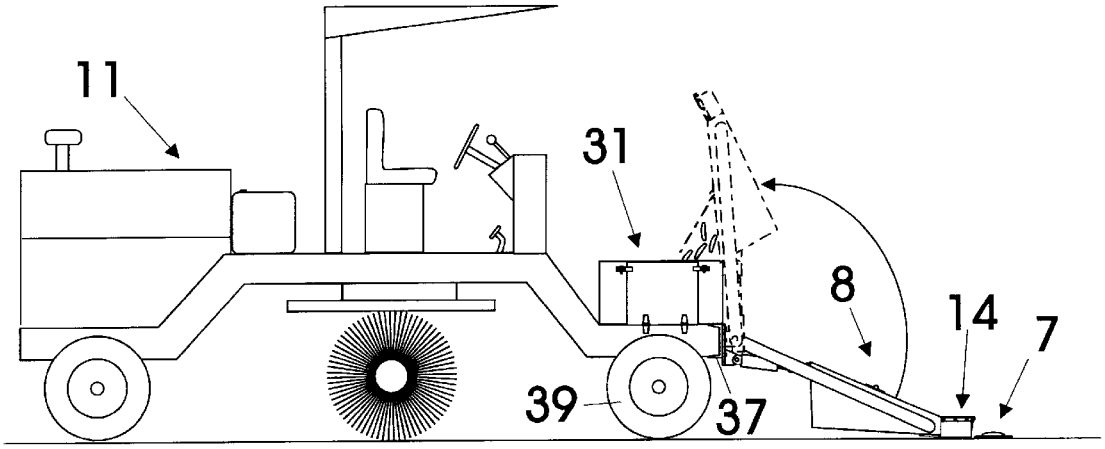
FIG. 1 is a schematic side elevation view of the apparatus of the invention in assembled relation to a transport vehicle, here illustrated as a roadway sweeper.
Figure 2:
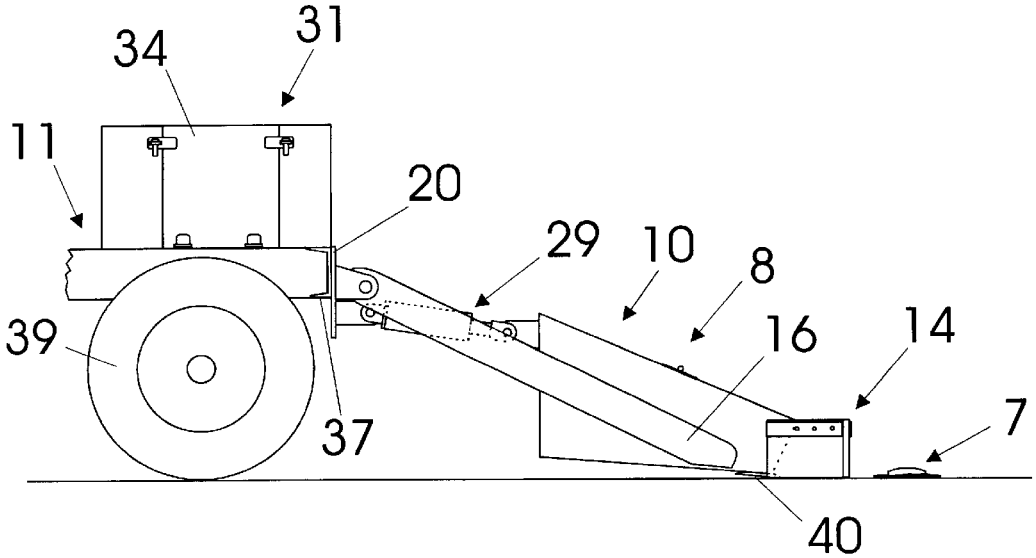
FIG. 2 is an enlarged scale, side elevation view of those portions of FIG. 1 constituting the apparatus of this invention.

Referring to FIG. 1 of the drawings, the apparatus embodying this invention is shown in assembled relation to a transport vehicle 11, which is shown as a roadway sweeper. Any transport vehicle having an hydraulic system and a weight of at least 1,000 pounds may be utilized, such as front end loaders, back-hoe loaders, skid shear loaders and motor graders. Most of such vehicles have a transverse frame beam 37 positioned forwardly adjacent to the wheels 39 of the vehicle, as shown in FIGS. 2 and 3.

Figure 3:
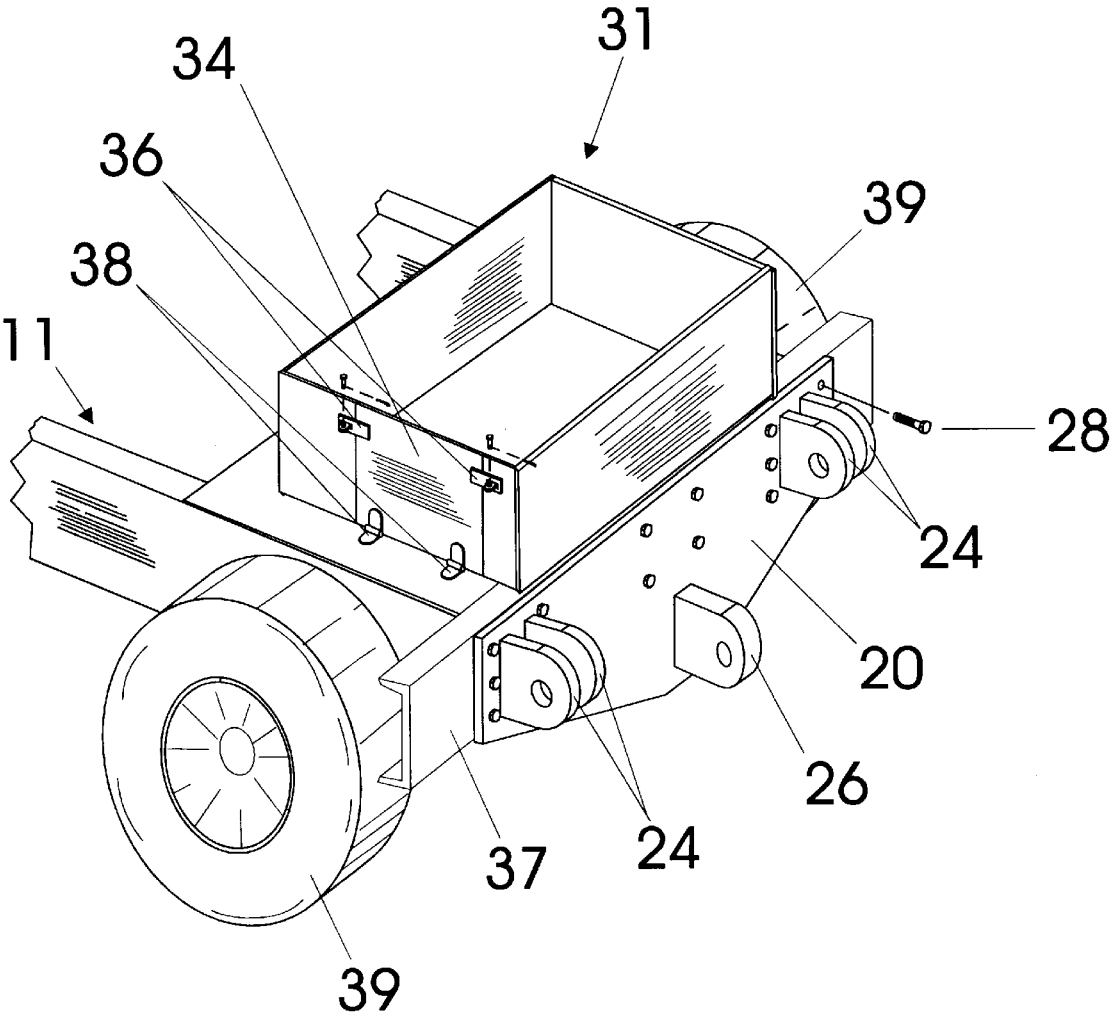
FIG. 3 is a perspective view of the mounting provided on a transport vehicle for the apparatus of this invention.

As best shown in FIG. 3, a mounting plate 20 is bolted or welded to the transverse frame beam 37. A pair of pivot mountings 24 are suitably secured to mounting plate 20 in laterally spaced relationship.

Figure 4:
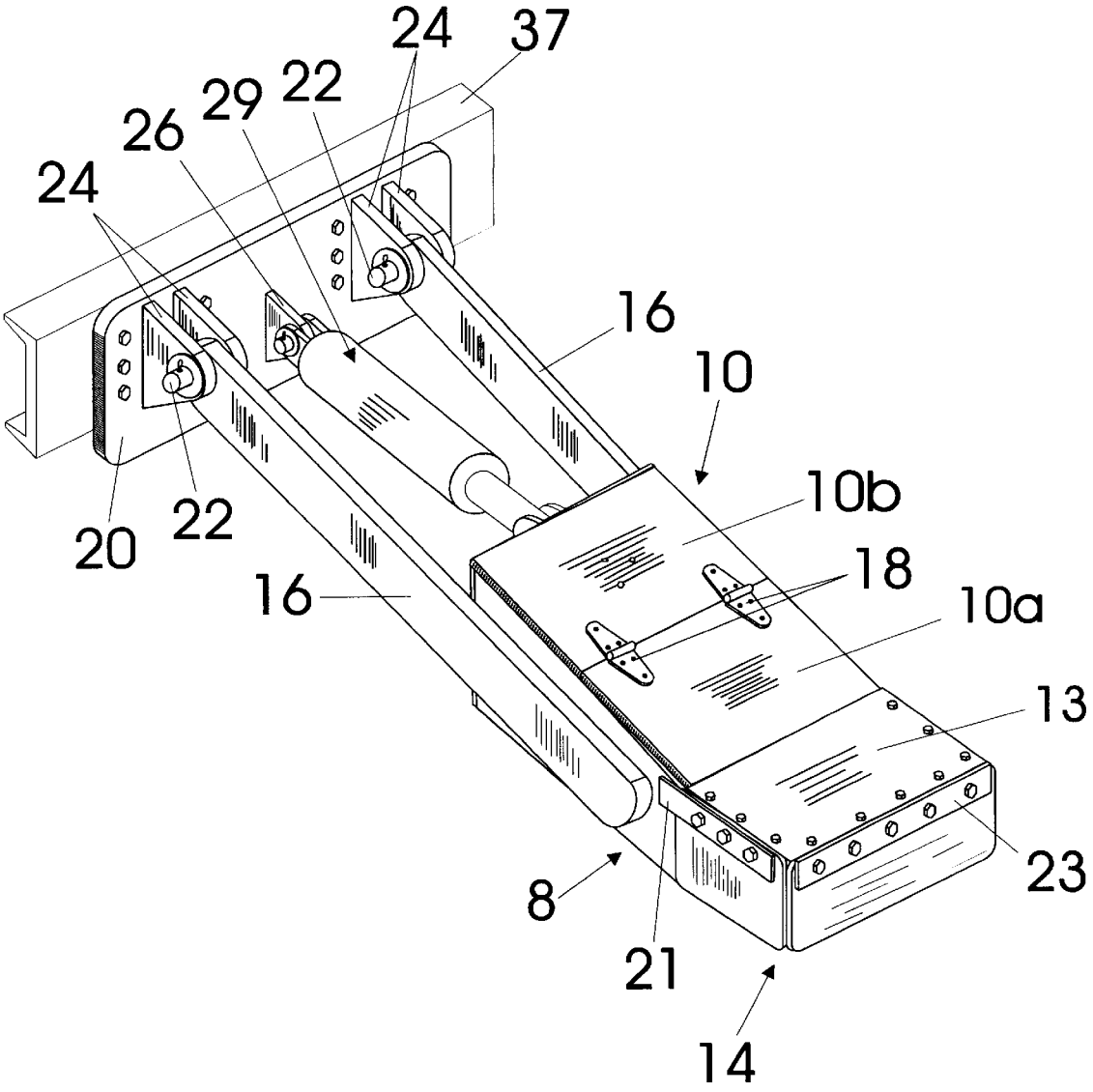
FIG. 4 is an enlarged scale perspective view of the apparatus of this invention except for the storage bin which is illustrated in FIGS. 1 and 3.
Figure 5:
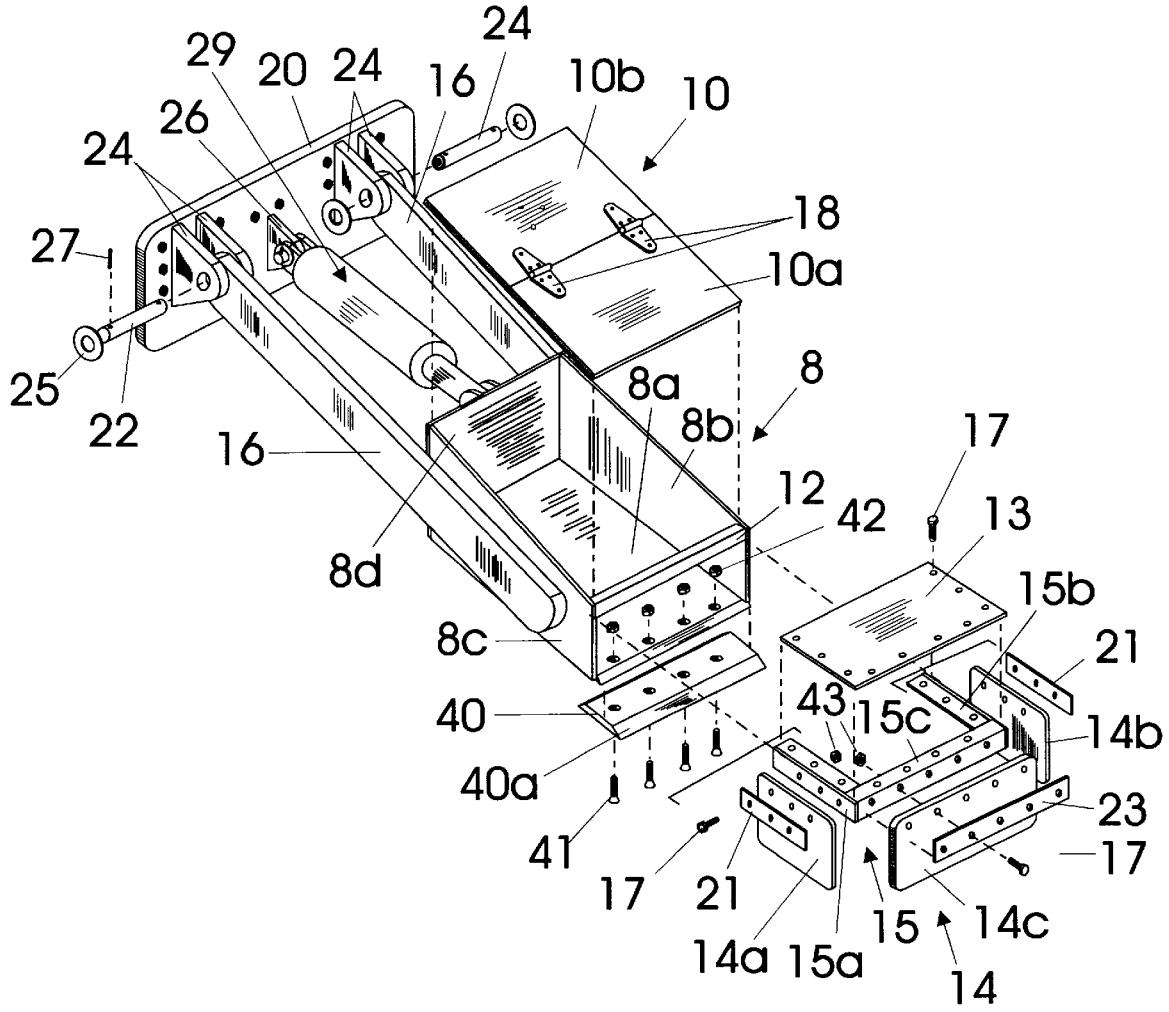
FIG. 5 is an exploded view of FIG. 4.

Referring to FIG. 4, a pair of support bars 16 are respectively pivotally secured to pivot mountings 24 by pivot pins 22. A generally rectangular collection bin 8 is provided having a planar bottom 8*a* and upstanding vertical side walls 8*b* and 8*c*, and a rear wall 8*d* (FIG. 5). Other than a transverse reinforcing bar 12, the bin 8 has no substantial front wall but the front of the bin is effectively closed by a vertical flexible skirt 14 as will be described. Side walls 8*b* and 8*c* of the collection bin 8 are respectively secured by bolts or welding to the support bars 16.

An hydraulic cylinder 29, preferably of the double action type, is pivotally mounted at one end to a mounting bracket 26 secured to the mounting plate 20 between the pivot mountings 24, and at the other end to the rear wall 8*d* of the collection bin 8. The application of a pressured fluid supplied by the hydraulic system normally provided on the vehicle 11 will effect the selective expansion or contraction of cylinder 29 to pivotally elevate collection bin 8 from a position vertically adjacent the roadway, as shown in FIG. 1 to a dumping position shown in dotted lines in FIG. 1. In the event that the transport vehicle does not have a readily accessible hydraulic system, an electrically operated solenoid can be substituted for the hydraulic cylinder 29.

A shearing blade 40 having two cutting edges 40*a* is secured by a plurality of bolts 41 and cooperating nuts 42 (FIG. 5) to the bottom surface 8*a* of the collection bin 8. One of the cutting edges is then disposed in forwardly projecting, depending relation to the open front wall of the collection bin 8.

The blade 40 is urged downwardly into contacting relation to the roadway surface by the weight of the collection bin 8 and its mounting arms 16, and additional downward force may be applied by contraction of the double acting cylinder 29.

An important feature of this invention is the provision of a vertically disposed flexible skirt 14 which is disposed forwardly of the blade 40 and surrounds the forward cutting edge 40*a* of such blade. Such flexible skirt functions as a closure for the open front end of the collecting bin 8, thus effecting the trapping in bin 8 of all roadway markers released from the roadway by the shearing action of the blade 40. Ideally, such flexible skirt should have a semicircular horizontal cross section, but the circular configuration is more difficult to rigidly mount such skirt on the collection bin 8.

In the preferred embodiment of this invention, the vertical flexible skirt 14 comprises two transversely spaced side sections 14*a* and 14*b* respectively projecting forwardly parallel to the side walls 8*b* and 8*c* of the collection bin 8, and a forward transverse vertical flexible skirt 14*c* disposed forwardly of the blade 40 by a distance greater than the diameter of the markers 7 to be removed from a roadway. Such forward spacing eliminates interference with the road marker when engaged by the blade 40.

A U-shaped subframe 15 formed by welding of three pieces of angle iron, has its two arm portions 15*a* and 15*b* respectively secured to the side walls of the collecting bin 8 by welding or bolts to position the bight portion 15*c* of the U-shaped subframe 15 forwardly of the blade 40 by a distance greater than the diameter of the roadway markers 7 to be removed from the roadway surface. The side sections 14*a* and 14*b* of the flexible skirt 14 are respectively secured to the forwardly projecting portions of the subframe 15 by clamping bars 21, bolts 17, and nuts 43. The transverse section 14*c* of the flexible skirt 14*a* is secured to the bight portion 15*c* of the U-shaped subframe 15 by clamping bar 23, bolts 17, and nuts 43.

A cover plate 13 is secured to the forwardly projecting, horizontal flanges of the subframe 15 by bolts 17 to define a trapping chamber for removed roadway markers 7 between the open front end of collecting bin 8 and the transverse section 14*c* of the flexible skirt 14. Obviously, the forward vertical edges of the side sections 14*a* and 14*b* of the flexible skirt 14 must be closely adjacent the vertical edges of the transverse section 14*c* of the flexible vertical skirt 14 to prevent loss of any roadway markers through the openings between the side sections and the transverse section of the flexible skirt 14.

Additionally, the entire flexible skirt 14 should be fabricated from a thick layer of a tough elastomer such as rubber or an equivalent plastic.

From the foregoing description, it will be apparent that when the blade edge 40*a* dislodges a roadway marker 7 from the roadway surface, such marker is loosely restrained in the chamber defined between the open front end of the collecting bin 8 and the flexible vertical skirt 14, and continued forward movement of the vehicle 11 will eventually flip each loose roadway marker 7 through the open front end of the collecting bin 8.

If it is desired to collect more roadway markers than permitted by the volume of the collecting bin 8, a large storage bin 31 may be mounted on the vehicle 11 at the position indicated in FIG. 1. Bin 31 has a discharge gate 34 mounted on pivots 38 and secured by latches 36 to facilitate removal of the collected roadway markers dumped into the larger storage bin 31 from the collecting bin 8.

A hinged lid 10 (FIG. 4) may be provided for collecting bin 8 which will open under the weight of the collected roadway markers when bin 8 is in its dumping position. Lid 10 comprises a plate 10*a* welded to the top forward portions of bin 8 and a second plate 10*b* connected by hinges 18 to overlie the rear portions of the bin 8. Plate 10*b* will be moved to an open position relative to the collecting bin 8 by the weight of the collected roadway markers when the collecting bin is shifted to its dumping position shown in FIG. 1.

This description of the preferred embodiment of this invention will obviously suggest modifications of the structures involved, and it is the intent of applicant to include such obvious modifications within the scope of the following claims.

I claim:

1. Apparatus for removal and collection of roadway markers secured to the surface of a roadway comprising:

a collection bin having a bottom surface, upstanding side walls, a rear wall interconnecting said side walls, and a forward opening opposite said rear wall;

a planar blade connected to the forward portions of said bottom surface in depending relation thereto and having a forwardly projecting cutting edge;

means for pivotally mounting said collection bin on a transport vehicle whereby said collection bin may be raised and lowered and whereby said blade may be positioned in abutting, slidable relation to a roadway traversed by the transport vehicle to shearably engage said cutting edge with roadway markers and remove such markers from the roadway; and a flexible vertical skirt mounted on said collection bin, said skirt forming a trapping chamber forward of said cutting edge of said blade, whereby said removed markers are directed to move through said forward opening of said collection bin to lie in said collection bin.

2. The apparatus of claim 1 further comprising a fluid pressure cylinder mountable between said collection bin and the transport vehicle, whereby said collection bin may be pivotally moved upwardly relative to the transport vehicle to effect the dumping of the collected roadway markers.

3. The apparatus of claim 2 further comprising an open top holding bin mountable on the transport vehicle in a position to receive the roadway markers intermittently dumped from said collection bin.

4. The apparatus of claim 1 wherein said vertical flexible skirt comprises a generally U-shaped configuration in horizontal cross section and having a base portion parallel to and forwardly spaced relative to said cutting edge of said blade, and arm portions extending back to a respective side wall of said collection bin; all of said vertical flexible skirt having a bottom edge closely spaced relative to the roadway surface, thereby preventing escape of roadway markers removed by said blade.

* * * * *